US012716629B2

(12) United States Patent
Rouhana

(10) Patent No.: US 12,716,629 B2
(45) Date of Patent: Aug. 25, 2026

(54) FLUID COLLECTOR

(71) Applicant: MAHLE International GmbH, Stuttgart (DE)

(72) Inventor: Hicham Rouhana, Korntal-Muenchingen (DE)

(73) Assignee: Mahle International GmbH, Stuttgart (DE)

( * ) Notice: Subject to any disclaimer, the term of this patent is extended or adjusted under 35 U.S.C. 154(b) by 293 days.

(21) Appl. No.: 18/381,624

(22) Filed: Oct. 18, 2023

(65) Prior Publication Data

US 2024/0133601 A1 Apr. 25, 2024
US 2024/0230186 A9 Jul. 11, 2024

(30) Foreign Application Priority Data

Oct. 19, 2022 (DE) ..... 10 2022 211 086.2

(51) Int. Cl.
*F25B 43/00* (2006.01)

(52) U.S. Cl.
CPC ..... *F25B 43/006* (2013.01); *F25B 43/003* (2013.01); *F25B 2400/16* (2013.01)

(58) Field of Classification Search
CPC .. F25B 43/006; F25B 43/003; F25B 2400/16; F25B 2339/0441; B60H 1/00507
See application file for complete search history.

(56) References Cited

U.S. PATENT DOCUMENTS 6,505,481 B2 1/2003 Neumann et al.
2011/0247792 A1 10/2011 Chikuma et al.

FOREIGN PATENT DOCUMENTS

DE 102007018722 A1 9/2008
EP 0621408 A1 * 10/1994 ..... F15B 15/1428
FR 3059400 A1 6/2018
WO WO-2010097392 A1 * 9/2010 ..... F28F 9/262

* cited by examiner

*Primary Examiner* — Waqaas Ali
(74) *Attorney, Agent, or Firm* — Muncy, Geissler, Olds & Lowe, P.C.

(57) ABSTRACT

A fluid collector having a housing having a tubular circumferential wall with a first end face having a first opening and with a second end face having a second opening, which is situated opposite the first opening of the first end face, a first cover being provided, which closes the first opening on the first end face, and a second cover being provided, which closes the second opening on the second end face. The tubular circumferential wall has an area with an, in particular, planar connecting surface, on which at least one flange element is arranged and fastened as a connecting element, at least one bore or one channel being provided in the area having the connecting surface, which fluidically connects the interior of the housing to the at least one connecting element.

11 Claims, 3 Drawing Sheets

FLUID COLLECTOR

This nonprovisional application claims priority under 35 U.S.C. § 119(a) to German Patent Application No. 10 2022 211 086.2, which was filed in Germany on Oct. 19, 2022, and which is herein incorporated by reference.

BACKGROUND OF THE INVENTION

Field of the Invention

The invention relates to a fluid collector, in particular a refrigerant collector for a refrigerant circuit, in particular of a motor vehicle.

Description of the Background Art

In motor vehicles, a refrigerant circuit is known, which is operated in an air conditioning circulation mode, in which a condenser, an evaporator, and a compressor are interconnected. A fluid collector, such as a refrigerant collector, is also typically provided in the refrigerant circuit, through which the refrigerant flows and in which refrigerant may be stored.

Fluid collectors of this type are known, for example, such that they are designed to form a single piece with the condenser and thus form a so-called condenser module, the fluid collector being fluidically connected between the condensing section of the condenser and the subcooling section of the condenser in the fluid flow. The housing of the fluid collector is tubular, and only two openings are provided in the tubular wall of the housing, which line up with two openings of the manifold of the condenser. The connection between the fluid collector and the manifold takes place by soldering the adjacent walls. Fluid collectors of this type are not suitable for a different place of use and/or a different purpose, since the design requires the direct wall-to-wall connection.

Fluid collectors are also known, which have pipe nipples on a cover plate or on a side wall of the tubular housing for inflow and outflow, which are welded or soldered to the housing so that hoses may be connected to these pipe nipples with the aid of hose clips, or the pipe nipples may be soldered directly to the condenser; cf., for example, FR 3 059 400 A1 or U.S. Pat. No. 6,505,481 B2.

A design of this type is also limited in space in such a way that the tubes must be prefabricated for the particular purpose and are therefore not flexible enough, and not enough space and surface area is present for a use of massive connecting flanges to connect the fluid collector to a fluid circuit for a secure and fluid-tight fastening of the massive connecting flange. There is also no way to provide a flexible arrangement of connecting flanges of this type, depending on the purpose and place of use.

SUMMARY OF THE INVENTION

It is therefore an object of the invention to provide a fluid collector, which may be designed for different connection situations and still be able to be manufactured easily and cost-effectively.

In an exemplary embodiment of the invention, a fluid collector is provided, in particular a refrigerant collector, which includes a housing having a tubular circumferential wall with a first end face having a first opening and with a second end face having a second opening, which is situated opposite the first opening of the first end face, a first cover being provided, which closes the first opening on the first end face, and a second cover being provided, which closes the second opening on the second end face, the tubular circumferential wall having an area with an, in particular, planar connecting surface, on which at least one flange element is arranged and fastened as a connecting element, at least one bore or one channel being provided in the area having the connecting surface, which fluidically connects the interior of the housing to the at least one connecting element. As a result, the fluid collector may be designed in such a way that the corresponding flange element or the flange elements may be positioned and connected on the connecting surface as needed so that a flexible design with little manufacturing complexity is achieved. The arrangement of the flange elements may be selected in different ways relative to its surroundings, depending on the connecting situation of the fluid collector, so that the fluid collector as a whole may be provided with a more flexible design. The design, quantity, and type of the flange elements may also be adapted to the connection situation without complications.

The area with which the, in particular planar, connecting surface can be designed to form a single piece with the circumferential wall of the housing, in particular manufactured as a single piece, for example by means of extrusion molding, extrusion, deep drawing, etc. The housing of the fluid collection may thus be manufactured cost-effectively while simultaneously manufacturing the circumferential wall and the variably usable connecting surface, in particular without the connecting surface having to be additionally fastened to the circumferential wall.

The area having the, in particular planar, connecting surface can be formed from a projection of the circumferential wall. As a result, the connecting surface is offset slightly from the circumferential wall in a targeted manner to create the necessary space for arranging the flange elements and to establish the necessary stability of the area with the connecting surface. This is important, in particular, since the stability of the connecting surface with regard to mechanical stresses is expected to be higher than the stability of the rest of the circumferential wall, to which no components are otherwise fastened and only the internal pressure is present as stress.

The projection can form a laterally protruding wing or forms two laterally protruding wings, which protrude in opposite directions from each other. The at least one laterally protruding wing or the two laterally protruding wings is/are used to widen or enlarge the available surface area for arranging or fastening the at least one flange element or the flange elements. Due to the enlargement of the available surface area, the arrangement of flange elements may also be shifted farther to the outside, an even more secure planar contact of the particular flange elements on the connecting surface still being able to be carried out, for example for the materially bonded and/or form-fitting connection, for example, for soldering, welding, gluing, screwing, and/or clamping, etc.

A flange element can be arranged and fastened as the connecting element, a bore or a channel being provided in the area having the connecting surface, which fluidically connects the interior of the housing to the one connecting element, or a flange element is arranged and fastened as the connecting element, two bores or two channels being provided in the area having the connecting surface, which fluidically connect the interior of the housing to the one connecting element, or two flange elements are arranged and fastened as connecting elements, two bore or two channels being provided in the area having the connecting surface, which fluidically connect the interior of the housing to one of the connecting elements in each case. As a result, the flange element may be arranged and fastened on the connecting surface, taking the available installation space into account, and a fluid connection to the interior of the housing of the fluid connector may be established without additional tubes or hoses being required. The profile of the bores or channels may thus take into account the outfit in the interior of the housing as needed.

The flange element can include an inflow connection or an outflow connection or an inflow connection and an outflow connection, or the two flange elements are designed in such a way that one of the two flange elements includes an inflow connection and the other of the two flange elements includes an outflow connection. Fluid may thus flow into the interior of the housing through the inflow connection and/or fluid may flow out of the interior of the housing through the outflow connection.

The bore or the channel connected to the inflow channel can be arranged at a distance from the one bore or the one channel connected to the outflow connection. For example, a seal may be arranged therebetween in the interior of the housing, so that a direct flow from the inflow connection to the outflow connection is prevented but instead must flow through, for example, an arranged filter.

A filter for filtering the through-flowing fluid and/or a dryer for drying the same can be arranged in the interior of the housing. The fluid, for example refrigerant in the interior, may thus not only be stored but also otherwise treated.

The filter can be inserted into the housing as an insert, a seal being provided, which is arranged on the inside of the circumferential wall, in particular running between the bores or between the channels. A forced through-flow of the filter may be achieved thereby, which is advantageous for filtering the fluid.

The dryer can be arranged so as to be integrated into the insert or is arranged separately from the insert, in particular as a filled container or a filled pouch, etc. The dryer may thus be placed easily and cost-effectively, an ability to replace the dryer thus being achieved as needed, for example in the case of a maintenance.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

The invention relates to a fluid collector 1, in particular a refrigerant collector. Fluid collectors 1 of this type, such as refrigerant collectors, may be used, for example, in a refrigerant circuit of a motor vehicle.

Figure 1:
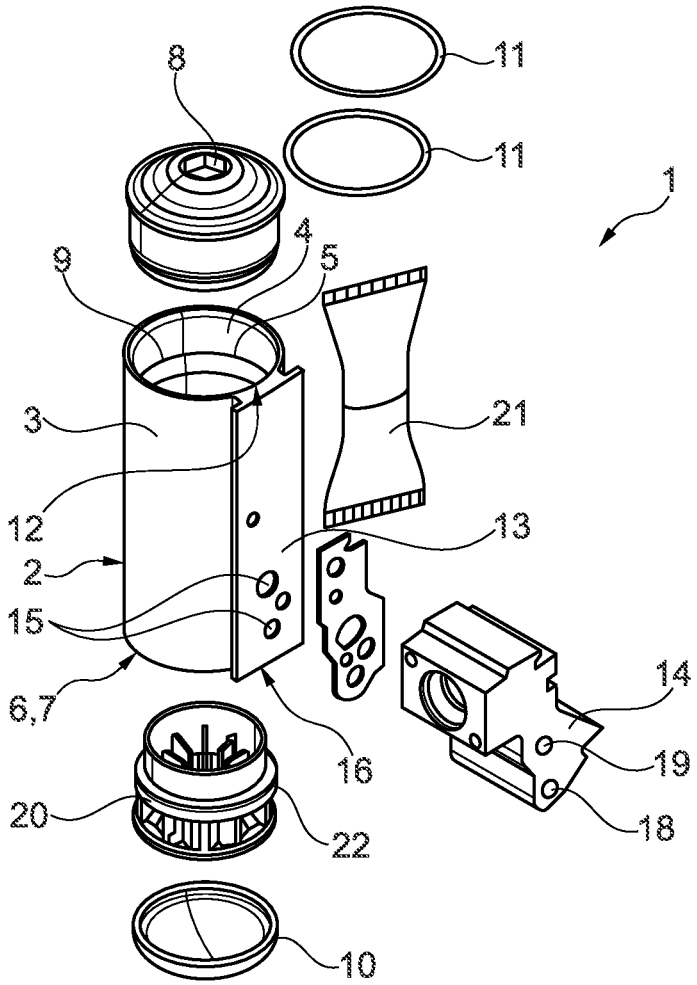
FIG. 1 shows a schematic exploded representation of an example of a fluid collector according to the invention.
Figure 4:
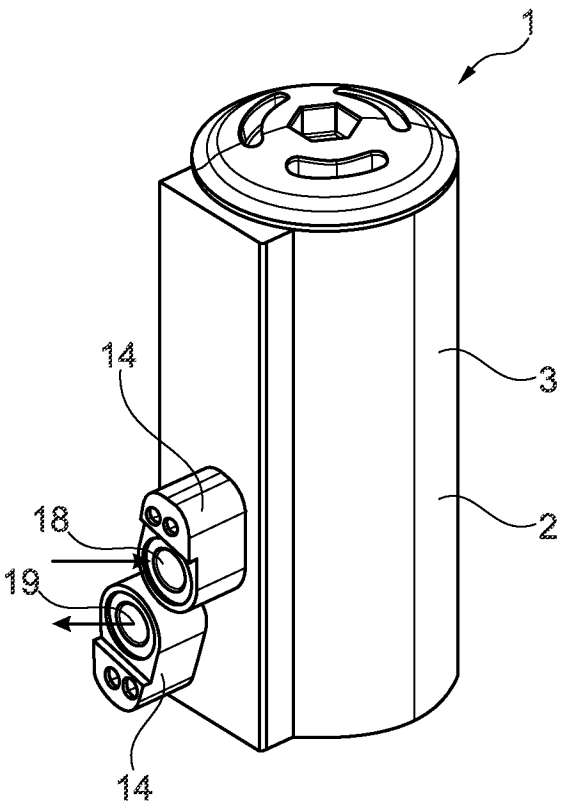
FIG. 4 shows a schematic perspective representation of an example of a fluid collector according to the invention.
Figure 2:
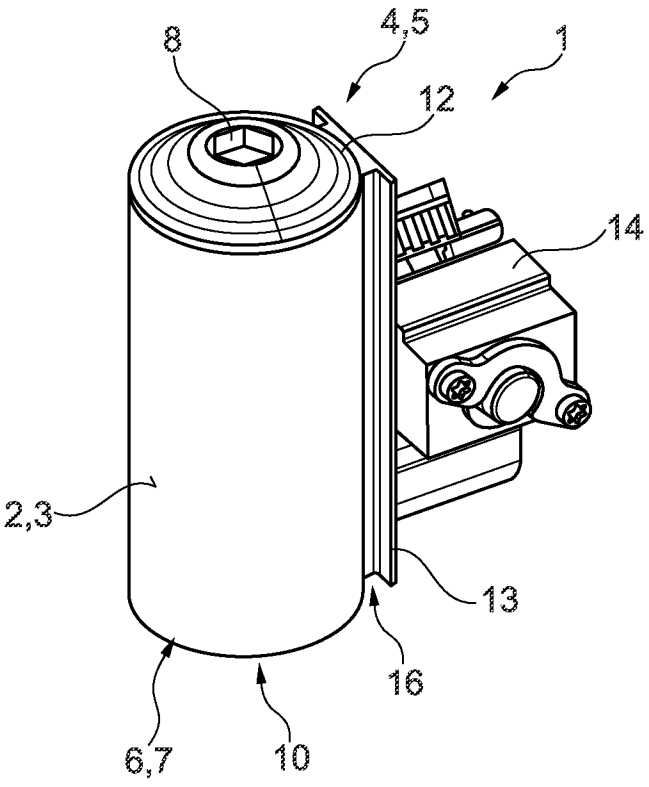
FIG. 2 shows a schematic perspective representation of the fluid collector according to FIG. 1.
Figure 3:
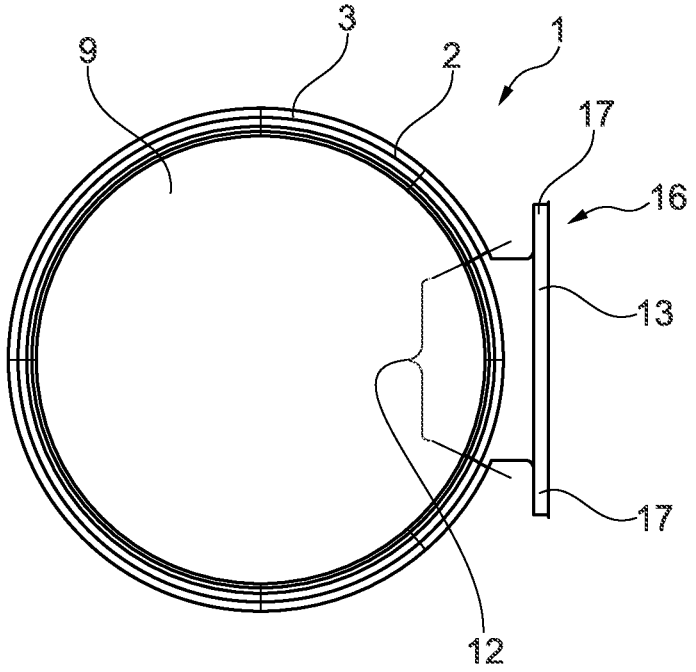
FIG. 3 shows a schematic sectional representation of the housing of the fluid collector according to FIG. 1.

FIGS. 1 through 3 show different representations of an example of a fluid collector 1, and FIG. 4 shows a further example of a fluid collector 1.

Fluid collector 1 according to the example in FIGS. 1 through 3, which is designed as an example of a refrigerant collector, includes a housing 2 having a tubular circumferential wall 3, tubular circumferential wall 3 of housing 2 being designed with a first end face 4 having a first opening 5 and with a second end face 6 having a second opening 7. Second end face 6 is situated opposite first end face 4, and first opening 5 is thus also situated opposite second opening 7.

In the illustrated example in FIGS. 1 through 3, a first cover 8 is provided, which closes first opening 5 on first end face 4. A second cover 10 is furthermore provided, which closes second opening 7 on second end face 6. Covers 8, 10 are preferably designed as plastic and/or metal covers, which are inserted into particular opening 5, 7 in a sealed manner and are fixed in position. For example, at least one sealing ring 11 or a sealing lip is provided for sealing purposes. Two sealing rings 11 are shown on first end face 4 in FIG. 1. Other seals may also be provided, for example an adhesive, etc.

Housing 2 has an interior 9, which is enclosed by circumferential wall 3. This interior 9 is used for the through-flow and storage of fluid, in particular refrigerant.

According to FIGS. 1 through 3, tubular circumferential wall 3 has an area 12 with an, in particular planar, connecting surface 13. In the illustrated example, this area 12 of wall 3 is a section of circumferential wall 3. which is designed to be thicker or more stable compared to the rest of the circumferential wall and which includes or forms connecting surface 13.

Connecting surface 13 in the illustrated example is designed as a rectangular planar surface, which is formed from area 12.

At least one flange element 14 or multiple flange elements 14 is or are arranged and fastened on connecting surface 13 as a connecting element or as connecting elements for the purpose of fluidically connecting or interconnecting fluid connector 1.

For this purpose, at least one bore 15 or one channel, which fluidically connects interior 9 of housing 2 to the at least one flange element 14, is provided as the connecting element in area 12 having connecting surface 13 for connecting the at least one flange element 14.

The at least one flange element 14 may be placed and fastened as needed on connecting surface 13, corresponding bore 15 or the corresponding channel then being suitably placed for this purpose. Particular flange element 14 may be fastened on connecting surface 13 in a materially bonded and/or form-fitting manner.

According to the illustrated example, area 12 having the, in particular planar, connecting surface 13 is designed to form a single piece with circumferential wall 3 of housing 2. Area 12 is manufactured with wall 3, for example to form a single piece, for example by means of extrusion molding, extrusion, deep drawing, etc. Housing 2 may thus be manufactured together with wall 3 and area 12.

It is also apparent from FIGS. 1 through 3 that area 12 having the, in particular planar, connecting surface 13 is formed from a projection 16 of circumferential wall 3. Projection 16 protrudes radially to the outside and forms connecting surface 13. For this purpose, area 12 is defined, for example, by projection 16.

According to FIG. 3, it is apparent that projection 16 forms at least one laterally protruding wing 17 or, as illustrated, two laterally protruding wings 17, which protrude in opposite directions from each other. The surface area of connecting surface 13 is enlarged on the side thereby, which allows the arrangement of the at least one flange element 14 to be designed more flexibly because more surface area is available for this purpose.

A flange element 14 may be arranged and fastened as the connecting element, a bore 15 or a channel being provided in area 12 having connecting surface 13, which fluidically connects interior 9 of housing 2 to the one connecting element, or a flange element 14 may be alternatively arranged and fastened as the connecting element, for example, two bores 15 or two channels being provided in area 12 having connecting surface 13, which fluidically connect interior 9 of housing 2 to the one connecting element, cf. FIGS. 1 through 3, or two flange elements 14 may also be arranged and fastened as connecting elements, two bores 15 or two channels being correspondingly provided in area 12 having connecting surface 13, which fluidically connect interior 9 of housing 2 to one of the connecting elements in each case, cf. FIG. 4.

The one flange element 14 may thus have an inflow connection 18 or an outflow connection 19 or an inflow connection 18 and an outflow connection 19, or the design may also be provided in such a way that the two flange elements 14 according to FIG. 4 are designed in such a way that one of the two flange elements 14 has an inflow connection 18 and the other of the two flange elements 14 has an outflow connection 19.

Bores 15 are arranged accordingly in such a way that the one bore 15 or the one channel connected to inflow channel 18 is arranged at a distance from the one bore 15 or the one channel connected to outflow connection 19; cf. FIG. 1.

It is also apparent from FIG. 1 that a filter 20 for filtering the through-flowing fluid and/or a dryer 21 for drying the same is/are arranged in interior 9 of housing 2.

Filter 20 may be inserted into housing 2 as an insert, a sealing lip 22 being able to be provided, which is arranged on the inside of circumferential wall 3, in particular running between bores 15 or between the channels.

Dryer 21 may be arranged so as to be integrated into the insert, or it may be arranged separately from the insert, in particular as a filled container or as a filled pouch, etc., cf. FIG. 1, in which dryer 21 is shown to be arranged in a pouch.

FIG. 4 shows a further example of a fluid collector 1, similar to the example of fluid collector 1 in FIGS. 1 through 3. However, projection 16 of area 12 does not have any laterally protruding wings. Two flange elements 14 are illustrated in FIG. 4 as flange elements 14, which each have only one inflow connection 18 or one outflow connection 19. Otherwise, reference is hereby made to the description of FIGS. 1 through 3 for the description of the fluid collector in FIG. 4.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A fluid collector comprising:

a housing having a tubular circumferential wall with a first end face having a first opening and a second end face having a second opening opposite the first opening;

a first cover closing the first opening;

a second cover closing the second opening;

at least one flange element, wherein the tubular circumferential wall comprises a planar connecting surface upon which the at least one flange element is fastened; and at least one bore or channel provided in the area of the planar connecting surface, fluidically connecting an interior of the housing to the at least one flange element;

wherein the area having the planar connecting surface is formed from a projection of the circumferential wall, the projection including two laterally protruding wings that extend in opposite directions;

wherein the at least one flange element is configured as a connecting element, and the at least one bore or channel is configured in one of the following arrangements:

a single bore or channel fluidically connecting the interior of the housing to the connecting element;

two bores or channels fluidically connecting the interior of the housing to the connecting element; or wherein the at least one flange element comprises two flange elements fastened as connecting elements, and the at least one bore or channel comprises two bores or channels, each fluidically connecting the interior of the housing to a respective one of the connecting elements.

2. The fluid collector according to claim 1, wherein the area having the planar connecting surface is manufactured as a single piece with the circumferential wall of the housing by extrusion molding, extrusion, or deep drawing.

3. The fluid collector according to claim 1, wherein the at least one flange element includes an inflow connection or an outflow connection or an inflow connection and an outflow connection, or wherein the at least one flange element includes two flange elements, with a first one of the two flange elements including an inflow connection and a second one of the two flange elements including an outflow connection.

4. The fluid collector according to claim 3, wherein the at least one bore or channel includes a first bore or channel and a second bore or channel, with the first bore or channel connected to the inflow connection and the second bore or channel connected to the outflow connection, the first bore or channel being arranged at a distance from the second bore or channel.

5. The fluid collector according to claim 1, wherein a filter for filtering a through-flowing fluid and/or a dryer for drying the through-flowing fluid is/are arranged in the interior of the housing.

6. The fluid collector according to claim 5, wherein the at least one bore or channel includes at least two bores or channels, wherein the filter is inserted into the housing, and wherein the filter has a sealing lip protruding therefrom, such that when the filter is inserted into the housing, the sealing lip is arranged on the inside of the circumferential wall so as to run between the at least two bores or channels.

7. The fluid collector according to claim 5, wherein the dryer is arranged so as to be integrated into the filter or is arranged separately from the filter or as a filled container or a filled pouch.

8. The fluid collector according to claim 1, wherein the fluid collector is a refrigerant collector.

9. A fluid collector comprising:

a housing having a tubular circumferential wall with a first end face having a first opening and with a second end face having a second opening that is arranged opposite the first opening of the first end face;

a first cover closes the first opening on the first end face;

a second cover closes the second opening on the second end face, at least one flange element, wherein the tubular circumferential wall has an area with a planar connecting surface, on which the at least one flange element is arranged and fastened; and at least two bores or channels being provided in the area having the planar connecting surface, which fluidically connect an interior of the housing to the at least one flange element, wherein a filter for filtering a through-flowing fluid and/or a dryer for drying the through-flowing fluid is/are arranged in the interior of the housing, and wherein the filter has a sealing lip protruding therefrom, such that when the filter is inserted into the housing, the sealing lip is arranged on the inside of the circumferential wall so as to run between the at least two bores or channels.

10. A refrigerant collector for a vehicle, the refrigerant collector comprising:

a housing having a tubular circumferential wall with a first end face having a first opening and with a second end face having a second opening that is arranged opposite the first opening of the first end face;

refrigerant provided inside of the housing;

a first cover closes the first opening on the first end face;

a second cover closes the second opening on the second end face, at least one flange element, wherein the tubular circumferential wall has an area with a planar connecting surface, on which the at least one flange element is arranged and fastened;

and at least one bore or channel being provided in the area having the planar connecting surface, which fluidically connects an interior of the housing to the at least one flange element;

wherein a filter for filtering a through-flowing fluid and/or a dryer for drying the through-flowing fluid is/are arranged in the interior of the housing, wherein the at least one bore or channel includes at least two bores or channels, wherein the filter is inserted into the housing, and wherein the filter has a sealing lip protruding therefrom, such that when the filter is inserted into the housing, the sealing lip is arranged on the inside of the circumferential wall so as to run between the at least two bores or channels.

11. The fluid collector according to claim 10, wherein the area having the planar connecting surface is formed from a projection of the circumferential wall, and wherein the projection includes two laterally protruding wings, which protrude in opposite directions away from each other.

* * * * *